US007150271B2

(12) United States Patent
Gonze et al.

(10) Patent No.: US 7,150,271 B2
(45) Date of Patent: Dec. 19, 2006

(54) VAPOR ASSISTED COLD START CONTROL ALGORITHM

(75) Inventors: Eugene V. Gonze, Pinckney, MI (US); Bernard Toton, Holly, MI (US); Thomas E. Bolander, Flint, MI (US)

(73) Assignee: General Motors Corporation, Detroit, MI (US)

( * ) Notice: Subject to any disclaimer, the term of this patent is extended or adjusted under 35 U.S.C. 154(b) by 182 days.

(21) Appl. No.: 11/017,366

(22) Filed: Dec. 20, 2004

(65) Prior Publication Data

US 2006/0130817 A1 Jun. 22, 2006

(51) Int. Cl.
*F02M 21/02* (2006.01)
*F02M 33/02* (2006.01)
*F02D 41/46* (2006.01)

(52) U.S. Cl. ..... 123/525; 123/516; 123/520

(58) Field of Classification Search ..... 123/516, 123/525, 527, 518, 519, 520
See application file for complete search history.

(56) References Cited

U.S. PATENT DOCUMENTS 4,312,317 A * 1/1982 Jewett et al. ..... 123/522
4,368,712 A * 1/1983 Jackson et al. ..... 123/523
4,426,984 A * 1/1984 Gilbert ..... 123/522
4,836,173 A * 6/1989 Stires, Jr. ..... 123/522
4,995,369 A * 2/1991 Cook ..... 123/520
5,048,493 A * 9/1991 Orzel et al. ..... 123/674
5,067,469 A * 11/1991 Hamburg ..... 123/520
5,090,388 A * 2/1992 Hamburg et al. ..... 123/674
5,203,300 A * 4/1993 Orzel ..... 123/339.12
5,216,995 A * 6/1993 Hosoda et al. ..... 123/520
5,249,561 A * 10/1993 Thompson ..... 123/520
5,373,822 A * 12/1994 Thompson ..... 123/520
5,474,049 A * 12/1995 Nagaishi et al. ..... 123/520
5,482,024 A * 1/1996 Elliott ..... 123/516
6,155,239 A * 12/2000 Dykstra ..... 123/522
6,318,345 B1 * 11/2001 Weber et al. ..... 123/520
6,330,825 B1 * 12/2001 Harness et al. ..... 73/118.1

OTHER PUBLICATIONS

Alkidas, A.C., "Intake-Valve Temperature Histories During S.I. Engine Warm-Up", SAE Paper 2001-01-1704, Society of Automotive Engineers, Inc., 2001.

* cited by examiner

*Primary Examiner*—Thomas Moulis
(74) *Attorney, Agent, or Firm*—Christopher DeVries

(57) ABSTRACT

An engine system according to the present invention includes an engine and a fuel system that delivers a liquid fuel and a vapor fuel to the engine. A control module communicates with the fuel system and modulates the vapor fuel delivered to said engine based on a determination of a desired vapor fuel rate and a maximum available vapor fuel rate of the fuel system. The control module determines the desired vapor rate based on a mass rate of liquid fuel being delivered to the engine and a coolant temperature of the engine. The control module determines a vapor density by estimating the vapor density based on a temperature of an intake manifold or alternatively receives a signal from a sensor.

20 Claims, 6 Drawing Sheets

VAPOR ASSISTED COLD START CONTROL ALGORITHM

FIELD OF THE INVENTION

The present invention relates to engine control systems, and more particularly to engine control systems that provide vapor enrichment of fuel flowing to an engine during cold start conditions.

BACKGROUND OF THE INVENTION

During combustion, an internal combustion engine oxidizes gasoline and combines hydrogen ($H_2$) and carbon (C) with air. Combustion creates chemical compounds such as carbon dioxide ($CO_2$), water ($H_2O$), carbon monoxide (CO), nitrogen oxides ($NO_x$), unburned hydrocarbons (HC), sulfur oxides ($SO_x$), and other compounds. During an initial startup period after a long soak, the engine is still "cold" after starting and combustion of the gasoline is incomplete. A catalytic converter treats exhaust gases from the engine. During the startup period, the catalytic converter is also "cold" and does not operate optimally.

In one conventional approach, an engine control module commands a lean air/fuel (A/F) ratio and supplies a reduced mass of liquid fuel to the engine to provide compensation. More air is available relative to the mass of liquid fuel to sufficiently oxidize the CO and HC. However, the lean condition reduces engine stability and adversely impacts vehicle drivability.

In another conventional approach, the engine control module commands a fuel-rich mixture for stable combustion and good vehicle drivability. A secondary air injection system provides an overall lean exhaust A/F ratio. The secondary air injector injects air into the exhaust stream during the initial start-up period. The additional injected air heats the catalytic converter by oxidizing the excess CO and HC. The warmed catalytic converter oxidizes CO and HC and reduces $NO_x$ to lower emissions levels. However, the secondary air injection system increases cost and complexity of the engine control system and is only used during a short initial cold start period.

SUMMARY OF THE INVENTION

An engine system according to the present invention includes an engine and a fuel system that delivers a liquid fuel and a vapor fuel to the engine. A control module communicates with the fuel system and modulates the vapor fuel delivered to the engine based on a determination of a desired vapor fuel rate and a maximum available vapor fuel rate of the fuel system.

In other features, the control module determines the desired vapor rate based on a mass rate of liquid fuel being delivered to the engine and a coolant temperature of the engine. The control module determines a vapor density by estimating the vapor density based on a temperature of an intake manifold or alternatively by receiving a signal from a vapor sensor.

In yet other features, the control module determines a maximum tank purge flow based on a signal provided by a MAP sensor in the intake manifold. The control module determines the maximum available vapor fuel rate based on the maximum tank purge flow and the vapor density. The control module determines if the maximum vapor rate is greater than the desired vapor rate. If it is, the control module modulates vapor fuel according to the desired vapor fuel rate. If it is not, the control module modulates vapor fuel according to the maximum vapor fuel rate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
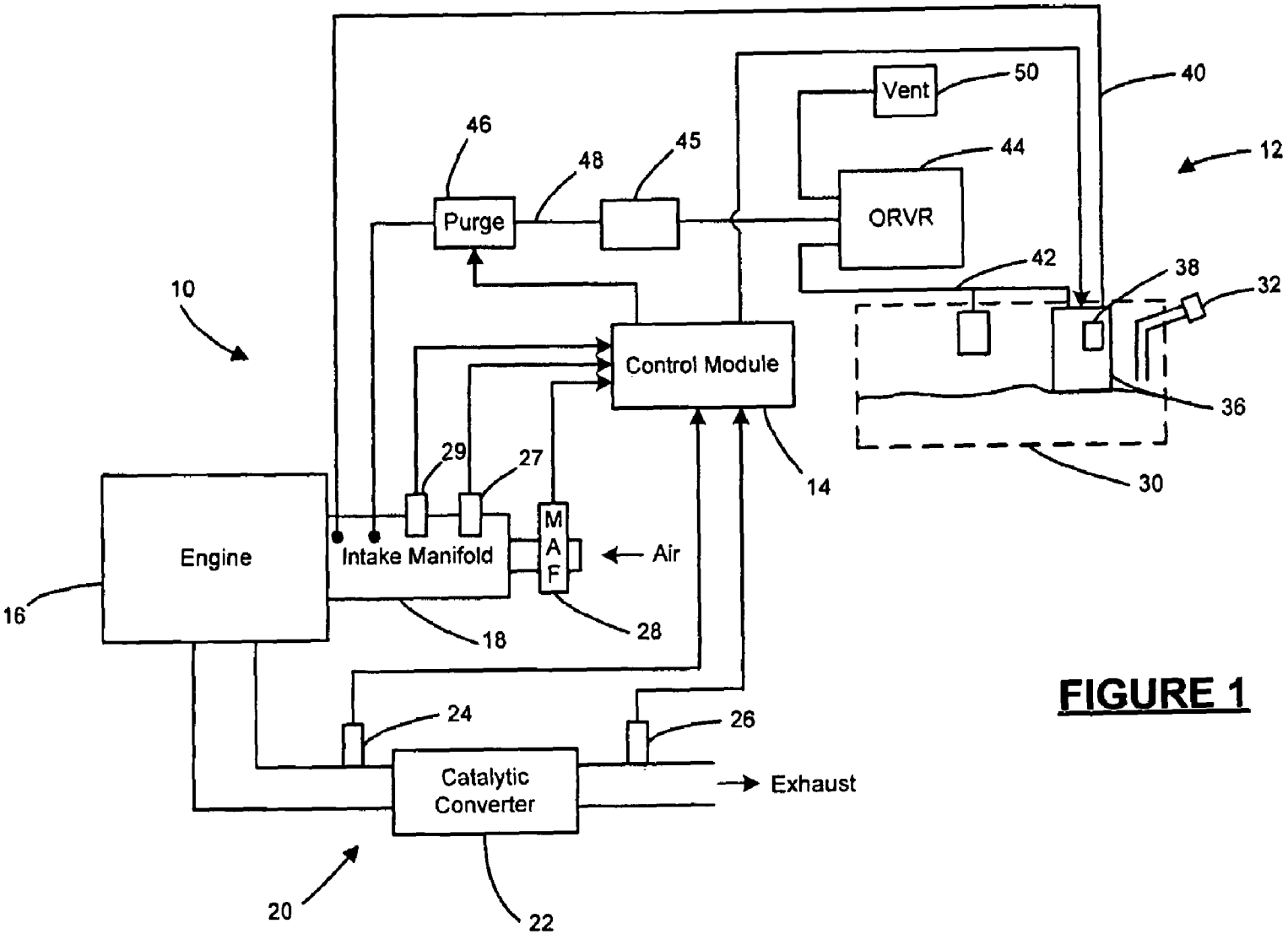
FIG. 1 is a functional block diagram of an engine control system and a fuel system.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring to FIG. 1, an engine system 10 and a fuel system 12 are shown. One or more control modules 14 communicate with the engine and fuel system 10, 12. The fuel system 12 selectively supplies liquid and/or vapor fuel to the engine system 10, as will be described in further detail below.

The engine system 10 includes an engine 16, an intake manifold 18, and an exhaust 20. Air and fuel are drawn into the engine 16 and combusted therein. Exhaust gases flow through the exhaust 20 and are treated in a catalytic converter 22. First and second $O_2$ sensors 24 and 26 communicate with the control module 14 and provide exhaust A/F ratio signals to the control module 14. A manifold absolute pressure (MAP) sensor 27 is located on the intake manifold 18 and provides a (MAP) signal based on the pressure in the intake manifold 18. A mass air flow (MAF) sensor 28 is located within an air inlet and provides a mass air flow (MAF) signal based on the mass of air flowing into the intake manifold 18. The control module 14 uses the MAF signal to determine the A/F ratio supplied to the engine 16. An intake manifold temperature sensor 29 generates an intake air temperature signal that is sent to the control module 14.

The fuel system 12 includes a fuel tank 30 that contains liquid fuel and fuel vapors. A fuel inlet 32 extends from the fuel tank 30 to allow fuel filling. A fuel cap 34 closes the fuel inlet 32 and may include a bleed hole (not shown). A modular reservoir assembly (MRA) 36 is disposed within the fuel tank 30 and includes a fuel pump 38. The MRA 36 includes a liquid fuel line 40 and a vapor fuel line 42.

The fuel pump 38 pumps liquid fuel through the liquid fuel line 40 to the engine 16. Vapor fuel flows through the vapor fuel line 42 into an on-board refueling vapor recovery (ORVR) canister 44. A vapor fuel line 48 connects a vapor sensor 45, a purge solenoid valve 46 and the ORVR canister 44. The control module 14 modulates the purge solenoid valve 46 to selectively enable vapor fuel flow to the engine 16. The control module 14 modulates a canister vent solenoid valve 50 to selectively enable air flow from atmosphere into the ORVR canister 44.

Figure 2:
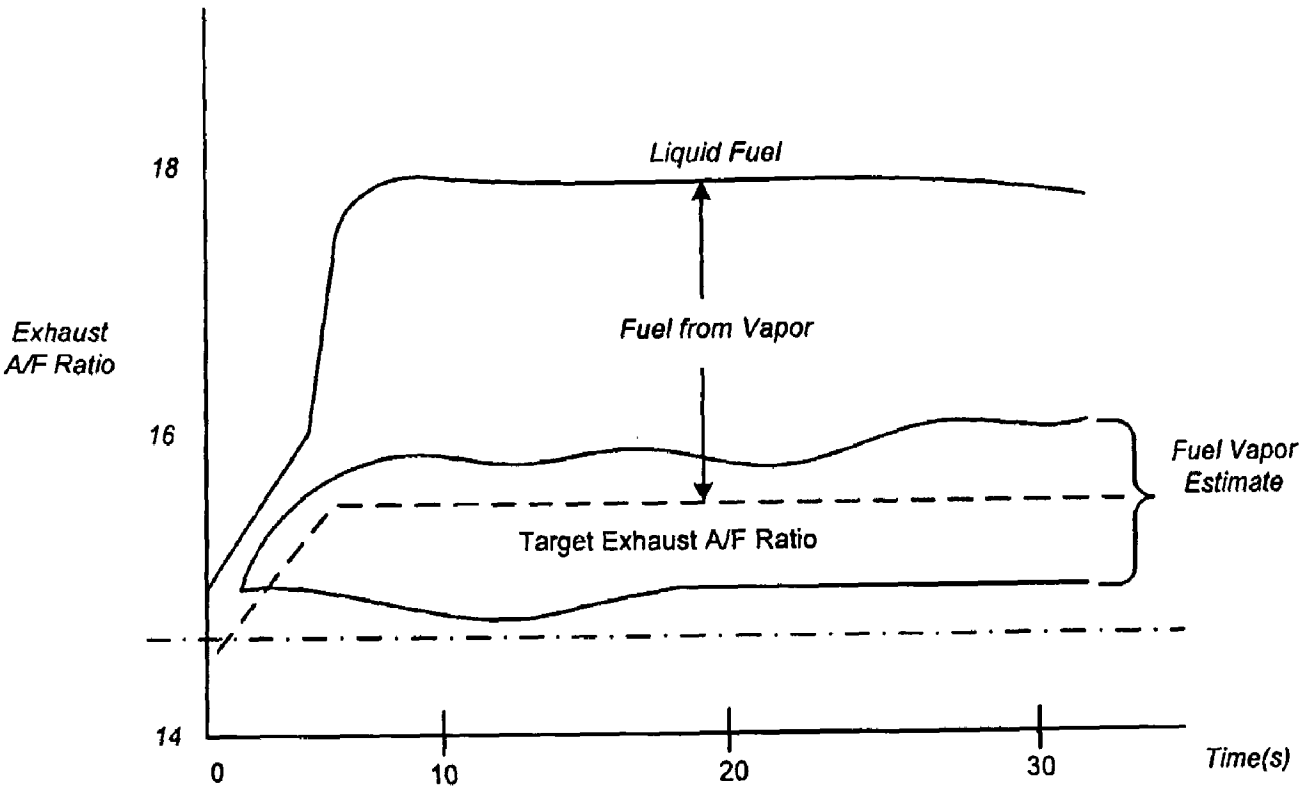
FIG. 2 is a graph illustrating a liquid fuel A/F ratio and a vapor fuel A/F ratio according to some implementations of the present invention.
Figure 3:
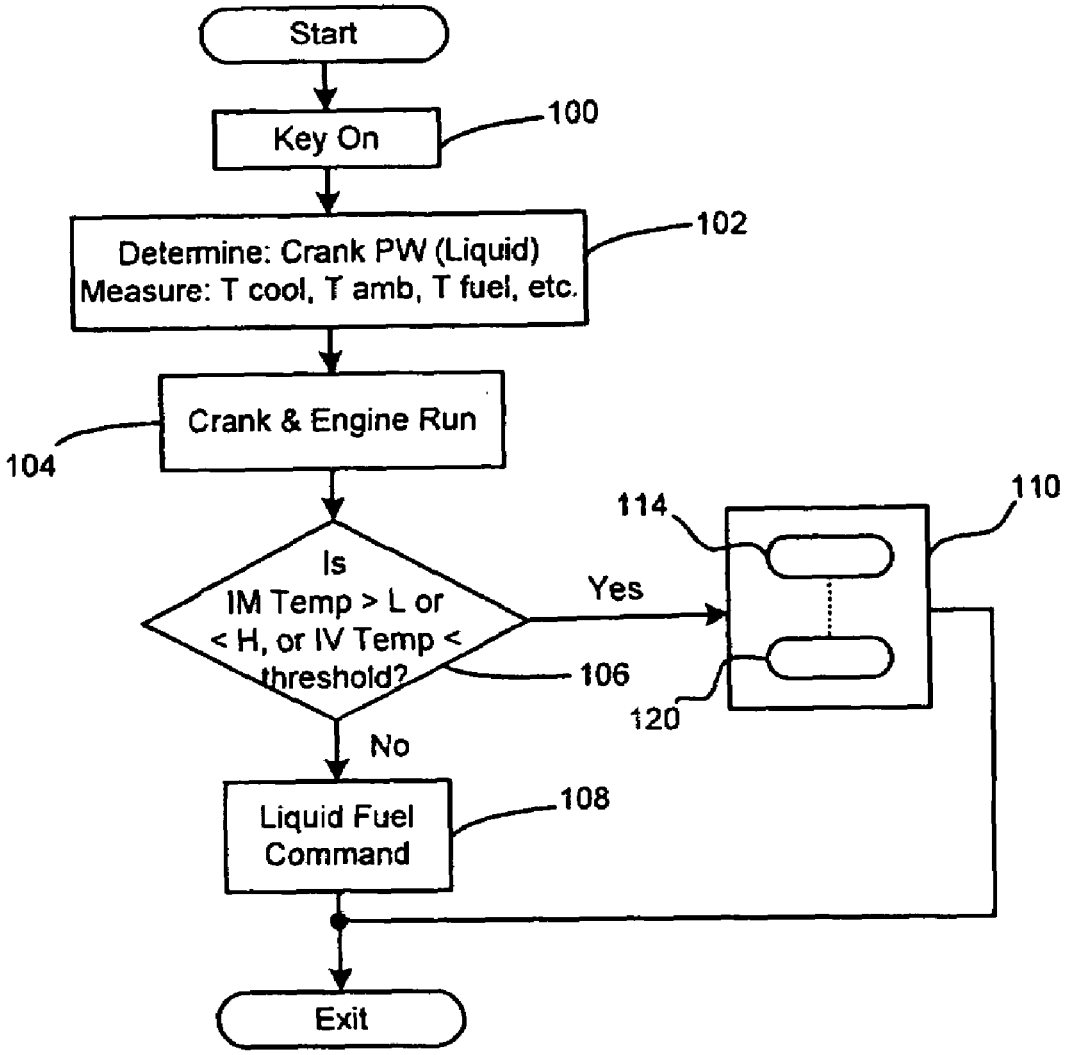
FIG. 3 is a flowchart showing steps of initiating a cold start fuel vapor assist control method according to the present invention.

Referring to FIGS. 2 and 3, a cold start fuel vapor assist control method will be described in further detail. In general, vapor fuel is used to supplement and enrich the A/F mixture during cold start of the engine 16. The vapor fuel within the fuel tank 30 retains a predictable A/F ratio between engine cold starts. The A/F ratio of the fuel can be estimated based on temperature and a Reid vapor pressure (RVP) rating of the fuel. In an exemplary manner, the RVP value of the fuel is estimated during closed loop, steady-state engine operation based on a hydrocarbon purge flow and the temperature of the fuel tank 30.

The vapor fuel is typically very rich. Therefore, a relatively small amount of vapor fuel is able to provide a significant portion of the fuel required to compensate the engine 16. Vapor fuel is present within the fuel tank 30 at atmospheric pressure. A sufficient amount of vapor fuel is usually available to handle throttle crowds and step-in maneuvers. As shown graphically in FIG. 2, fuel vapor having an A/F ratio within the designated range of approximately 2 to approximately 3, can be supplied in conjunction with liquid fuel having an A/F ratio of up to 18 or 20, to achieve a target exhaust A/F ratio of about 15.5.

As detailed in FIG. 3, after a key-on event occurs in step 100, the control module 14 determines the amount of liquid fuel required during engine crank (i.e. initial ignition). Currently available parameters including engine coolant temperature ($T_{COOL}$), ambient air temperature ($T_{AMB}$), and fuel temperature ($T_{FUEL}$) are measured in step 102. In step 104, the engine is cranked and initially runs and burns the liquid fuel having an initial A/F ratio. In step 106, the intake manifold temperature ($T_{IM}$) is measured and compared to a predetermined temperature range. If $T_{IM}$ falls outside of the temperature range, the control module 14 operates the engine using only liquid fuel in step 108. If $T_{IM}$ falls within the temperature range, the control module 14 initiates a vapor enrichment mode. In one embodiment, the predetermined temperature range is between approximately 30° F. and 85° F., although other temperature values may be used.

Alternatively, in step 106, intake valve temperature is estimated and compared to a threshold value. The intake valve temperature is estimated based on engine coolant temperature, engine speed, manifold absolute pressure (MAP), and an equivalence ratio. The equivalence ratio is defined as the stoichiometric A/F ratio divided by the actual A/F ratio. A predictive model for intake valve temperature is provided in "Intake-Valve Temperature and the Factors Affecting It", Alkidas, A. C., SAE Paper 971729, 1997, which is incorporated herein by reference in its entirety. If the intake valve temperature is greater than the threshold value, the control module 14 operates the engine using only liquid fuel in step 108. If the intake valve temperature is less than the threshold value, the control module 14 initiates the vapor assist mode in step 110. The threshold temperature is provided as 120° C., however, it is appreciated that the specific value of the threshold temperature may vary.

Figure 4:
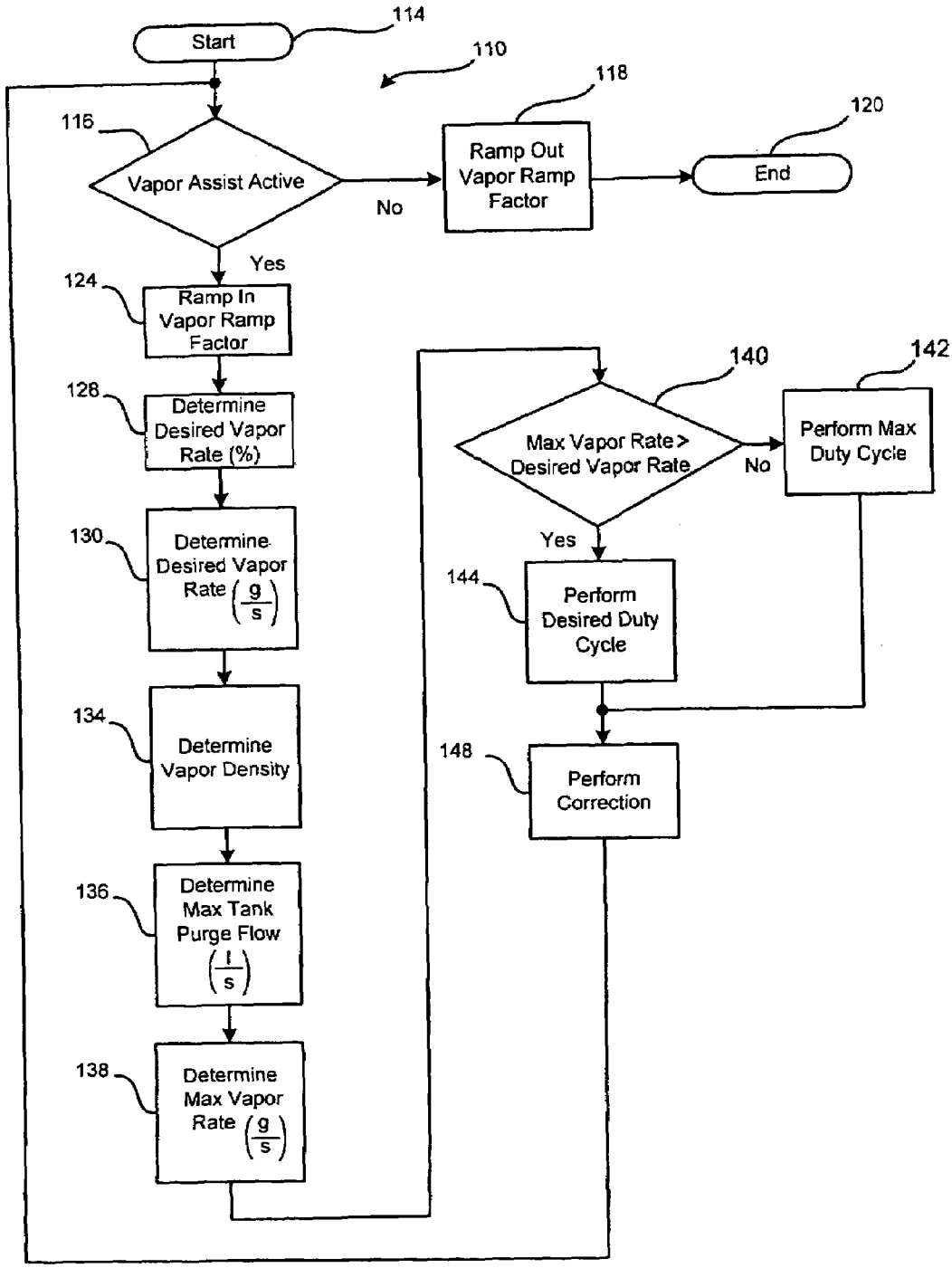
FIG. 4 is a flowchart showing detailed steps of a cold start fuel vapor assist control method according to some implementations of the present invention.
Figure 5:
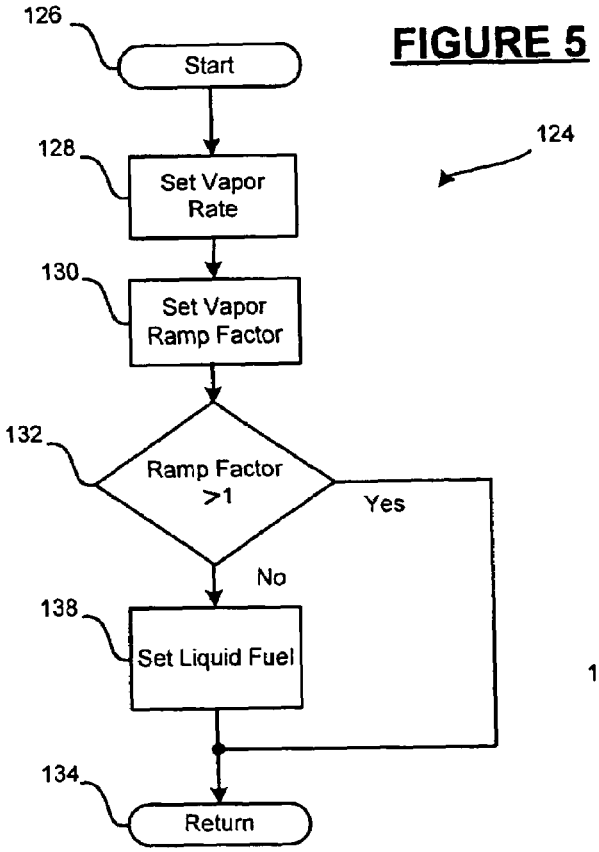
FIG. 5 is a flowchart showing steps of ramping in vapor assist according to some implementations of the present invention.
Figure 6:
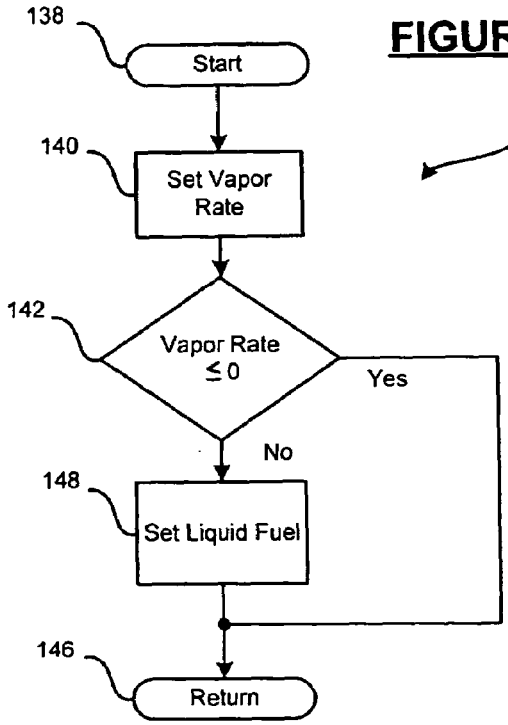
FIG. 6 is a flowchart showing steps of ramping out vapor assist according to some implementations of the present invention.

Turning now to FIG. 4, the vapor assist mode 110 will be described in greater detail. Control begins in step 114. In step 116, control determines if vapor assist is active. If vapor assist is not active, control ramps out a vapor ramp factor (VRF) in step 118 and ends in step 120. If the vapor assist is active, control ramps in the VRF in step 124. VRF is used to incrementally increase the amount of flow of vapor fuel delivered to the engine 16. The steps for ramping vapor fuel out and in, 118 and 124, respectively, will be described in greater detail later.

In step 128, a desired vapor rate (%) is determined. The desired vapor rate may be a percentage (%) estimated based on the engine coolant temperature ($T_{COOL}$) provided by the intake manifold temperature sensor 29 and may be determined through a look up table. In step 130, a desired vapor rate defined as a flow rate in (g/s) is determined. The desired vapor rate (g/s)=a liquid fuel mass rate (g/s)*desired vapor rate(%). The liquid fuel mass rate is the mass of liquid fuel injected into the engine 16.

In step 134, a vapor density is determined. The vapor density may be estimated in (g/l) based on the intake manifold temperature ($T_{IM}$) through a lookup table. Alternatively, the vapor density may be measured by the vapor sensor 45.

In step 136, a maximum tank purge flow (l/s) is determined. The maximum tank purge flow (l/s) may be estimated based on the signal provided by the (MAP) sensor 27 through a lookup table. In step 138, a maximum vapor rate (g/s) is determined. The maximum vapor rate (g/s) may be calculated based on the following equation:

$$\text{max vapor rate (g/s)} = \text{max tank purge flow (l/s)} * \text{vapor density (g/l)} * C;$$

where C is the canister effects associated with the ORVR canister 44. The canister effects C will be described in greater detail later.

In step 140, control determines if the max vapor rate (g/s) is greater than the desired vapor rate (g/s). If the max vapor rate (g/s) is not greater than the desired vapor rate (g/s), control sets an actual vapor rate $VR_{actual}$ to the max vapor rate in step 142. The actual vapor rate, $VR_{actual}$ is controlled by modulating the purge solenoid valve 46, such as by pulse width modulation. If the max vapor rate (g/s) is greater than the desired vapor rate (g/s), control sets the actual vapor rate $VR_{actual}$ equal to the desired vapor rate (g/s) in step 144. The actual vapor rate, $VR_{actual}$ is a function of (MAP), desired vapor rate (g/s) and vapor density (g/l). More specifically the $VR_{actual}$ may be characterized as a vapor duty cycle. The vapor duty cycle is the amount of vapor the purge solenoid valve 46 allows to flow to the engine 16, such as by pulse width modulation. The vapor duty cycle is a function of (MAP) and the ratio of desired vapor rate (g/s) and vapor density (g/l). The vapor duty cycle may be determined through a lookup table.

In step 148 control performs corrections in response to vapor assist including a vapor A/F correction, a vapor assist A/F correction and a warm up spark correction. These corrections account for the liquid fuel supplemented with vapor fuel resulting from vapor assist. The vapor A/F correction compensates for vapor assist and is a function of actual vapor rate, $VR_{actual}$. The vapor A/F correction may be determined through a lookup table. The vapor assist A/F correction is equal to the sum of a start-up enrichment factor and the vapor A/F correction. The start-up enrichment factor is a variable established based on operating conditions and may be determined through a lookup table. The warm-up spark correction is a function of the actual vapor rate, $VR_{actual}$, engine RPM and engine load. The warm up spark correction may be determined through a lookup table.

Step 124, ramping in the VRF, will be described in more detail. Control begins in step 126. In step 128, the $VR_{actual}$ is set to the desired vapor rate. In step 130, the VRF is determined according to the following equation:

$$(VRF)_n=(VRF)_{n-1}+\text{vapor fill};$$

where vapor fill is a function of tank purge flow (through the purge valve 46) and airflow to the engine 16 (through the MAF 28). The vapor fill may be determined through a lookup table. In step 132, control determines if the VRF is greater than 1. If the VRF is greater than 1, control returns in step 134. If the VRF is not less than 1, liquid fuel is determined in step 138. The liquid fuel is determined according to the following equation:

$$(\text{liquid fuel})_n=(\text{liquid fuel})_{n-1}-(VR_{actual}*VRF)$$

Control returns in step 134.

Step 118, ramping out the VRF, will be described in greater detail. The $VR_{actual}$ is determined in step 140 according to the following equation:

$$(VR_{actual})_n=(VR_{actual})_{n-1}-(MAF)$$

In step 142 control determines if the $VR_{actual}$ is less than or equal to 0. If the $VR_{actual}$ is less than or equal to 0, control returns in step 146. If the $VR_{actual}$ is not less than or equal to 0, liquid fuel is determined in step 148 according to the following equation:

$$(\text{liquid fuel})_n=(\text{liquid fuel})_{n-1}-(VR_{actual})$$

Control returns in step 146.

Figure 7:
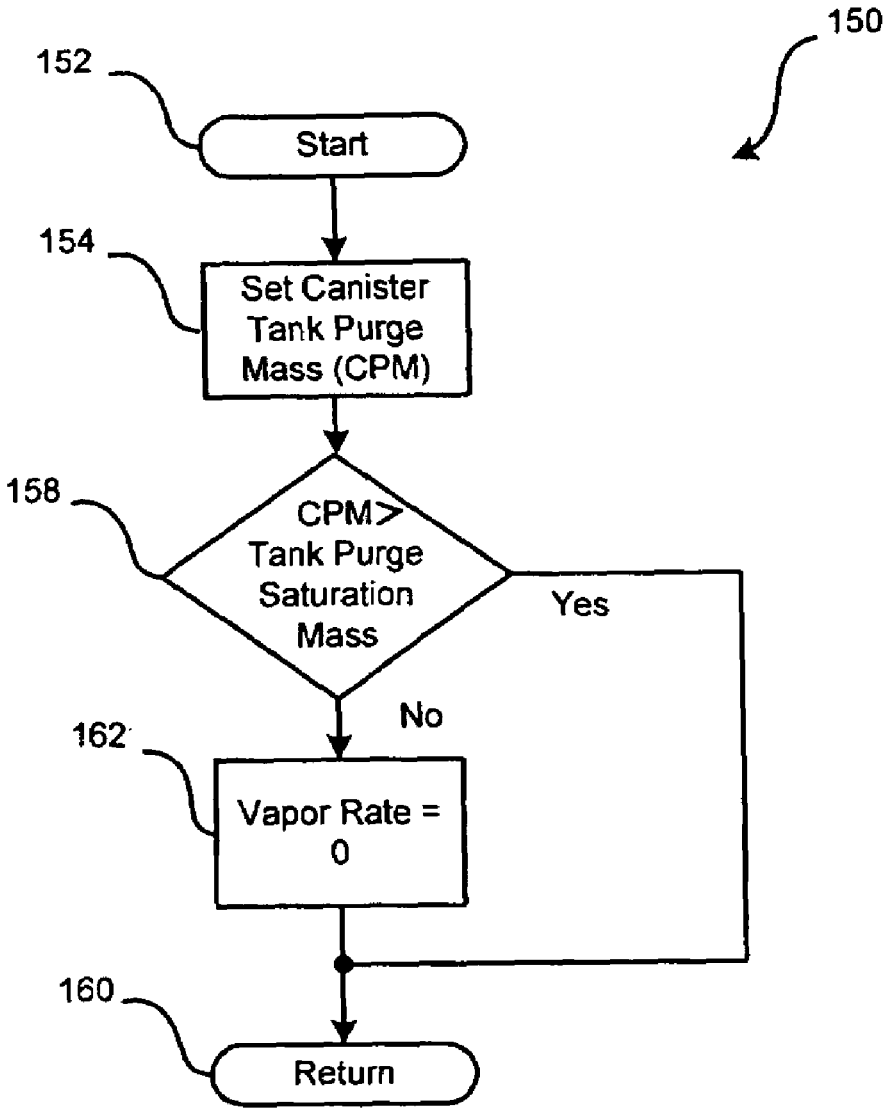
FIG. 7 is a flowchart showing steps of estimating canister effects according to some implementations of the present invention.

Turning now to FIG. 7, estimation of the canister effects C is shown and identified generally at reference 150. The canister effects C is determined to account for canister saturation. Canister saturation may be measured as a function of mass and referred to as tank purge saturation mass (TSM). Canister saturation occurs when the absorption media, such as carbon, within the ORVR canister 44 cannot absorb additional fuel vapor. Control begins in step 152. In step 154, a canister tank purge mass (CPM) is determined according to the following equation:

$$(CPM)_n=(CPM)_{n-1}+(\text{tank purge flow})*(\text{vapor density})*(\text{time})$$

In step 158, control determines if (CPM) is greater than a tank purge saturation mass (TSM). If the (CPM) is greater than the (TSM), control returns in step 160. If the (CPM) is not greater than the (TSM), the vapor rate is set to 0 in step 162. Control ends in step.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine system comprising:

an engine;

a fuel system that delivers a liquid fuel and a vapor fuel to said engine; and a control module that communicates with said fuel system and that modulates said vapor fuel injected into said engine based on a determination of a desired vapor fuel rate and a maximum available vapor fuel rate of said fuel system.

2. The engine system of claim 1 wherein said control module determines said desired vapor rate based on a mass rate of liquid fuel being delivered to said engine and a coolant temperature of said engine.

3. The engine system of claim 2 wherein said control module determines a vapor density.

4. The engine system of claim 3 wherein said control module estimates said vapor density based on a temperature of an intake manifold communicating air to said engine.

5. The engine system of claim 3 wherein said control module determines a vapor density based on a signal from a vapor sensor in said fuel system.

6. The engine system of claim 3 wherein said control module determines a maximum tank purge flow based on a signal provided by a MAP sensor in an intake manifold of said engine.

7. The engine system of claim 6 wherein said control module determines said maximum available vapor fuel rate based on said maximum tank purge flow and said vapor density.

8. The engine system of claim 7 wherein said control module determines if said maximum vapor rate is greater than said desired vapor rate, and wherein said control module modulates vapor fuel according to said desired vapor fuel rate if said maximum vapor rate is greater than said desired vapor rate, and wherein said control module modulates vapor fuel according to said maximum vapor fuel rate if said maximum vapor rate is not greater than said desired vapor rate.

9. A method of operating a combustion engine with a fuel system delivering liquid fuel and vapor fuel, the method comprising:

determining a maximum available vapor rate of said vapor fuel into said engine;

determining a desired vapor rate of said vapor fuel into said engine; and modulating said vapor fuel delivered to said engine based on said maximum available vapor rate and said desired vapor rate.

10. The method of claim 9 wherein said desired vapor rate is based on a mass rate of said liquid fuel and a coolant temperature of said engine.

11. The method of claim 10, further comprising determining a vapor density of said vapor fuel.

12. The method of claim 11 wherein determining said vapor density includes estimating said vapor density based on a temperature of an intake manifold communicating air to said engine.

13. The method of claim 11 wherein determining said vapor density includes communicating a signal from a vapor sensor in said fuel system.

14. The method of claim 11, further comprising determining a maximum tank purge flow based on a signal provided by a MAP sensor in an intake manifold of said engine.

15. The method of claim 14 wherein said maximum available vapor rate is based on said maximum tank purge flow and said vapor density.

16. The method of claim 14, further comprising determining if said maximum vapor rate is greater than said desired vapor rate, and modulating said vapor fuel according to said desired vapor fuel rate if said maximum vapor rate is greater than said desired vapor rate, and modulating vapor fuel according to said maximum vapor fuel rate if said maximum vapor rate is not greater than said desired vapor rate.

17. A method of operating a combustion engine with a fuel system delivering liquid fuel and vapor fuel, the method comprising:

determining whether a vapor assist mode is active;

determining a vapor ramp factor based on said vapor assist being active;

determining a maximum available vapor rate of said vapor fuel into said engine;

determining a desired vapor rate of said vapor fuel into said engine; and modulating said vapor fuel delivered to said engine based on said ramp factor, said maximum available vapor rate and said desired vapor rate.

18. The method of claim 17 wherein determining said vapor ramp factor includes determining a ramp in factor based on said vapor assist being active and determining a ramp out factor based on said vapor assist being inactive.

19. The method of claim 18 wherein said ramp in factor is based on an airflow delivered to said engine and a flow of vapor fuel into said engine.

20. The method of claim 18 wherein said ramp out factor is based on a flow of vapor fuel into said engine.

* * * * *